United States Patent [19]

Terrasse et al.

[11] Patent Number: 4,802,528

[45] Date of Patent: Feb. 7, 1989

[54] HOOPS FOR CONTINUOUS CASTING ROLLS

[75] Inventors: Joseph J. Terrasse; Andre Boucher, both of St. Ferreol; Michel Seux, Chambon Feugerolles, all of France

[73] Assignee: Chavanne - Ketin, Puteaux, France

[21] Appl. No.: 191,820

[22] PCT Filed: Mar. 14, 1986

[86] PCT No.: PCT/FR86/00086

§ 371 Date: Nov. 14, 1986

§ 102(e) Date: Nov. 14, 1986

[87] PCT Pub. No.: WO86/05423

PCT Pub. Date: Sep. 25, 1986

Related U.S. Application Data

[63] Continuation of Ser. No. 939,479, Nov. 14, 1986, abandoned.

[30] Foreign Application Priority Data

Mar. 15, 1985 [FR] France ..... 8503867

[51] Int. Cl.[4] ..... B22D 11/06; B22D 11/128

[52] U.S. Cl. ..... 164/428; 164/429; 164/448; 29/132

[58] Field of Search ..... 164/448, 428, 429, 479, 164/480; 29/132; 428/586

[56] References Cited

U.S. PATENT DOCUMENTS

| | | | |
|---|---|---|---|
| 3,587,708 | 6/1971 | Khimich et al. | 164/480 |
| 4,232,096 | 11/1980 | Franzen . | |
| 4,538,668 | 9/1985 | Nishihara et al. | 164/448 |

FOREIGN PATENT DOCUMENTS

| | | | |
|---|---|---|---|
| 0025394 | 3/1981 | European Pat. Off. . | |
| 2018601 | 11/1970 | Fed. Rep. of Germany . | |
| 2217098 | 9/1974 | France . | |
| 2374159 | 7/1978 | France . | |
| 59-174253 | 10/1984 | Japan | 164/480 |

*Primary Examiner*—Kuang Y. Lin

*Attorney, Agent, or Firm*—Cushman, Darby & Cushman

[57] ABSTRACT

The invention relates to hoops for rollers for the continuous casting of aluminium, characterized in that they are in the form of forged cylindrical casings which have undergone heat treatment and machining and consist of an alloy steel having the following composition in percentages by weight: C: 0.30 to 0.36; Mn: 0.30 to 0.60; Si: 0.15 to 0.45; Ni: Less than 0.40; Cr: 2.80 to 3.40; Mo: 0.85 to 1.25; V: 0.10 to 0.30; S:≦0.020; P:≦0.020; Cu:≦0.30, the remainder being substantially iron and residual impurities.

2 Claims, 2 Drawing Sheets

FIG.1
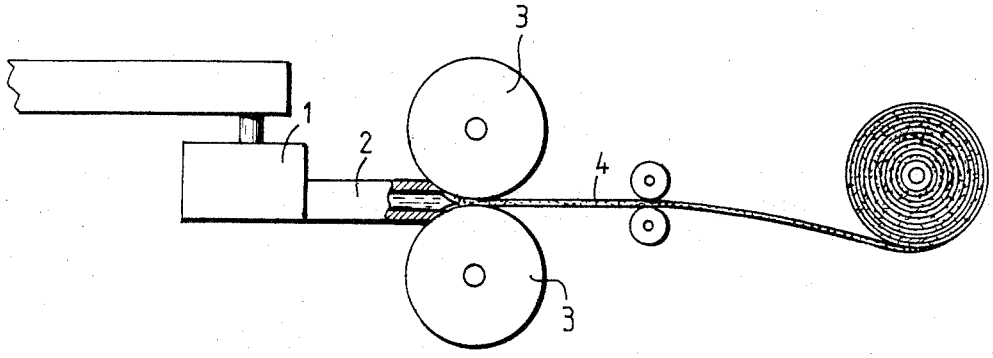
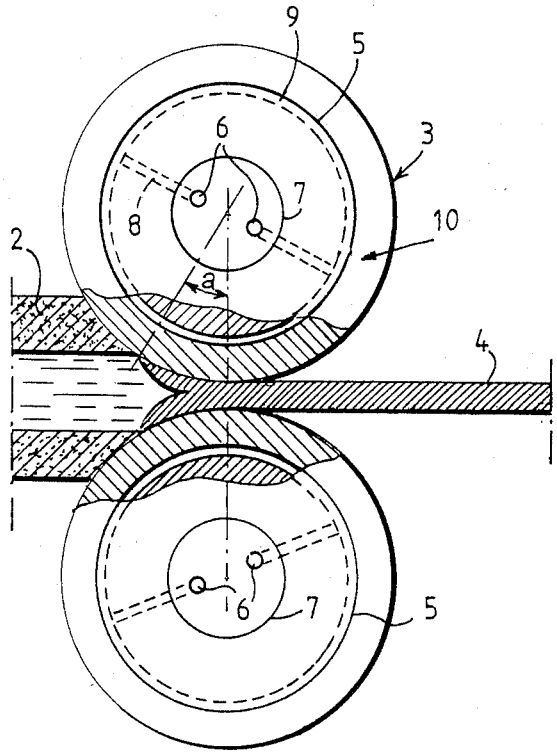
FIG.2

HOOPS FOR CONTINUOUS CASTING ROLLS

This is a continuation of application Ser. No. 939,479 filed Nov. 14, 1986, which was abandoned upon the filing hereof.

The invention relates to hoops for rollers for the continuous casting of aluminium alloys, these hoops having improved life in comparison with hoops made of traditional steels and maintaining good productivity of the casting machine.

In the continuous production of cast aluminium the molten metal is directly cast at a temperature of about 680° between a pair of cooled contrarotating rollers, which serve the dual purpose of solidifying the metal as a strip and hot rolling this metal.

It will be understood that the cylinders could not turn at a very high speed, because the alloy must be given the time to solidify in contact with the roller and must be enabled to undergo a certain rolling action.

In order to obtain maximum productivity of the installation, the rollers must be effectively cooled and have good thermal conductivity in order to assist the dissipation of calories. These rollers consist of two parts: a central core provided with cooling means and a hoop which is mounted on said core and comes into direct contact with the cast aluminium.

This hoop constitutes the part of the roller which takes the heaviest stressing, and after operating for a certain number of hours it must be overhauled because of the development of cracks caused by heat.

The first characteristic required of a material for making continuous casting machine hoops is good thermal conductivity. However, during operation these hoops are subjected to a certain types of stress of mechanical origin, namely hooping, flexion, torsion. These stresses dictate minimum mechanical strength and tenacity.

The main stress is thermal cycling, which results in plastic fatigue of the surface, and the initiation and propagation of a network of microcracks. This deterioration necessitates periodic reconditioning of the hoop, an operation which consists in machining off the layer of damaged metal.

Alloy steels normally used up to the present time for the production of these hoops corresponded to the following composition by weight in %:

C: 0.53 to 0.57; Mn: 0.70 to 0.90; Si: 0.20 to 0.40; Ni: 0.40 to 0.70; Cr: 0.90 to 1.30; Mo: 0.40 to 0.60; V: 0.10 to 0.20 with a content of S≦0.020 and a content of P≦0.020.

These steels are advantageous in respect of thermal conductivity properties and therefore the productivity of the installation, but on the other hand have limited resistance to cracks of thermal origin, with the consequence that their operating life is shorter and remachining is required more frequently, so that the consumption of hoops is increased.

Steels for hoops for the continuous casting of aluminium are also known which have the following composition by weight in %:

C: 0.53 to 0.58; Mn: 0.40 to 1; Si: 0.1 to 0.2; Ni: 0.45 to 0.55; Cr: 1.5 to 3.0; Mo: 0.8 to 1.2; V: 0.3 to 0.5, with S≦0.020 and P≦0.020.

These steels have good mechanical strength and operating life properties, but they do not enable productivity results comparable with those obtained with the steels previously described to be achieved.

The present invention seeks to provide new hoops for the continuous casting of aluminium which, while retaining high productivity of the installation together with good thermal conductivity, ensure an operating life at least comparable to the best products in use at present, this being achieved by the use of an alloy steel having high resistance to fatigue of thermal origin.

The invention thus has as its object a hoop for rollers for continuous casting of aluminium, characterized in that it is in the form of a forged cylindrical jacket which has undergone heat treatment and been machined, and which is composed of an alloy steel having the following composition in percentages by weight:

C: 0.30 to 0.36; Mn: 0.30 to 0.60; Si: 0.15 to 0.45; Ni less than 0.40; Cr: 2.80 to 3.40; Mo: 0.85 to 1.25; V: 0.10 to 0.30; S≦0.020; P: ≦0.020; Cu: ≦0.030, the remainder being substantially iron and residual impurities.

In a preferred embodiment the composition is as follows:

C: 0.31 to 0.35; Mn: 0.30 to 0.50; Si: 0.15 to 0.35; Ni less than 0.25; No: 0.90 to 1.10; V: 0.13 to 0.20; S≦0.020; P≦0.020; Cu: ≦0.30, the remainder being substantially iron and residual impurities.

BRIEF DESCRIPTION OF THE DRAWINGS

The invention is explained below in detail with reference to the accompanying drawings, in which:

FIG. 1 is a schematic view of a horizontal continuous casting installation;

FIG. 2 is a schematic view in side elevation and partly in sectin of a part of the installation shown in FIG. 1;

DETAILED DESCRIPTION

Figure 3:
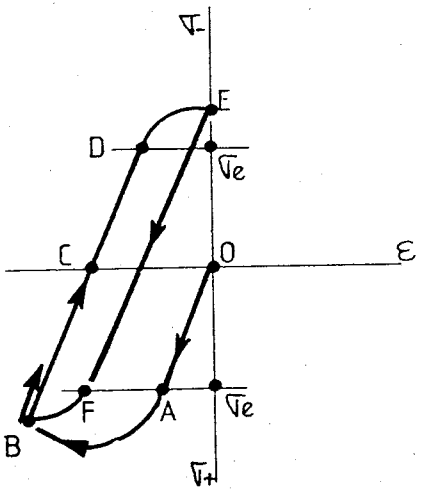
FIG. 3 is a diagram illustrating the cycle of stresses plotted against the elongation undergone by the metal of the hoop.

The principle of the continuous casting of light alloys shown in FIGS. 1 and 2 relates to socalled horizontal casting. Aluminium melted in a furnace (not shown) is kept at a constant level in a feed duct 1 and introduced by means of a nozzle 2 having an outlet end between two rolls 3 at a temperature close to 680°. The rolls (or cylinders) 3 are driven rotationally in opposite directions, the distance between them determining the desired thickness of the solidified sheet 4. The roll nip constitutes a continuous ingot mould in which the cast aluminium solidifies in contact with the cold cylinders, while it is driven by the rotation of the cylinders.

Each roll has a cooling circuit through which a fluid, generally water, flows. Each roll is made in two parts, namely: a core 5 consisting of a steel cylinder in which longitudinal passageways or channels 6 are provided for the inlet and outlet of water through the journals 7 and the feeding of peripheral grooves 9 by way of radial passageways or channels 8, and a hoop or sleeve 10 which is mounted on the core in such a manner as to be in direct contact with the cooling fluid circulating in the grooves 9. This hoop constitutes the consumable part of the roll. Its first task is to remove calories from the solidifying alloy. It will be realized that the productivity of the casting machine is directly linked to the transfer of calories through the hoop.

As previously stated, this hoop must have good thermal conductivity, but also appropriate mechanical properties because of the stresses to which it is subjected. The stress regime at any point on the hoops is defined by the cumulation of stresses of mechanical origin and stresses of thermal origin due to the cycling of the temperature gradient.

The origins of the mechanical stresses are the following:

the hooping (static stresses);

the driving torque which results in torsional and shear stresses;

the rolling pressure which gives rise to flexion of the cylinders, and a distribution of compression and shear stresses in the cylindner nips.

Because of its principle, the operation of hot hooping produces residual stresses in the hoop. These stresses have been evaluated by different approximation formulae or calculated by the finite element method.

A certain number of residual stress measurements have been made by the X-ray method on hoops of different types. The results corroborate the calculations. Depending on the type of roll and the hooping conditions, the order of magnitude of residual stresses after hooping is as follows:

circmferential tensile stress: 100 to 250 MPa;

longitudinal tensile stress: 50 to 150 MPa.

It should be noted that during operation the hoops are slightly displaced. The residual longitudinal stresses will very quickly disappear. On the other hand, the circumferential tensile stresses due to shrinkage persist.

Operating stresses have also been calculated for a determined type of casting machine Torsion: shear stresses due to the driving torque are very low, of the order of 1 MPa. Their effect is therefore entirely negligible.

Flexion: in the course of a rotation the longitudinal stresses due to flexion pass through a maximum in compression with contact between the sheet and the cylinder, and then through a maximum in tension in the opposite position; the order of magnitude of these stresses is +70 MPa.

The effect of rolling acting on the alloy sheet during and just after its solidification is slight and is applied to a material whose yield stress is very low. The Hertz shear stresses produced in the hoop are therefore very moderate and can be ignored.

Each rotation of the roll brings its skin into contact with the liquid aluminium within the arc of contact a. This gives rise to a temperature gradient in the thickness of the hoop. When contact is ended, the rotation then allows the stressed zone to cool.

It is known that any variation of temperature produces a deformation in volume. The homogeneous temperature variation of a free, homogeneous material entails a variation of volume but no stress.

Stress exists if:

the structure is fixed at its supports;

the structure is not homogeneous (thus giving rise to different coefficients of expansion);

the temperature is not homogeneous: the fibres attempt to expand differentially but are embedded in neighbouring fibres, thus giving rise to a state of stresses dependent on the temperature gradient.

In the case of the hoops the inner face may be considered to be at a constant temperature close to that of the cooling water. On each rotation the outer face comes into contact with the liquid aluminium and then, when the metal sheet has passed out of the roll nip, the hoop is cooled by the ambient air and by the transfer of heat to the cooling fluid.

The thermal evolution has been studied by the introduction of thermocouples into the thickness of the hoops. The results of this study inspired the definition of the thermal cycle imposed on the simulation test piece in the test for resistance to fatigue of thermal origin described below and utilized in the present description.

Each cycle induces in the skin of the hoop a maximum compressive stress the value of which can be estimated, as a first approximation and assuming that the material is perfectly elastic, by the relationship:

$$\sigma_{max.} = \frac{E \cdot \alpha \cdot \Delta\theta}{1 - \nu}$$

in which E=Young's modulus.

$\alpha$=coefficient of expansion.

$\Delta\theta$=surface temperature - internal temperature.

$\upsilon$=Poisson's ratio.

Taking into account the temperature reached on the surface of the hoop, it can be seen that the stress level reaches and exceeds the elastic limit of the steel. The heating of the hoop skin in contact with the liquid aluminium therefore entails a plastic deformation of the skin.

The cycle of stresses is illustrated in FIG. 3.

The first heating is represented by the line OA and then by the curve AB, which corresponds to the plastic deformation on the stress-deformation diagram shown in FIG. 3.

When cooling occurs, the deformation will tend to disappear, but the metal will not be able to resume its position elastically because during the heating it has undergone deformation in the plastic range in compression. The return to the low temperature will give rise at D to the exceeding of the elastic limit in tension and entail plastic deformation, in tension this time, as far as the point E.

The second cycle, starting from E, will once again result in the exceeding of the elastic limit under compression, at F, and the cycle will continue around E F B D, giving rise each time to:

plastic deformation "FB" on heating;

plastic deformation "DE" on cooling.

This cycle of deformation of thermal origin will inevitably give rise to mechanical fatigue of the surface, which will result in the initiation and then the propagation of microcracks.

The stresses of mechanical origin - residual hooping stresses and flexion stresses - are slight. For steels they do not pose any problems of mechanical characteristics.

The preponderant stresses are those induced by the thermal cycle (on which of course the stresses of mechanical origin, although slight, are superimposed).

The essential property demanded of a continuous casting hoop, apart from thermal conductivity, is therefore "resistance to thermal fatigue".

If it were possible to reduce the extent of the temperature gradient cycle, the maximum level of stresses would be lowered and the appearance of cracks would be delayed. However, this cycle is tied to the process itself.

It has been indicated above that for a steel the maximum stress on the skin could be evaluated by the relationship:

$$\sigma_{max.} = \frac{E \cdot \alpha \cdot \Delta\theta}{1 - \nu}$$

An increase of Poisson's ratio would reduce the maximum stress. However, this ratio is tied more closely to the crystalline structure of the alloy than to its composition.

Alloys having a high coefficient of expansion are avoided from the outset. However, the differences in coefficient of expansion which may exist between the different types of tool steels are not sufficiently significantly great to enable them to be used as an essential criterion of choice.

A reduction of the modulus of elasticity (Young's modulus) would make it possible, all other factors being the same, to lower the maximum stress level. Nevertheless, although the modulus of elasticity of a steel can certainly be measured, its correlation with composition is rather complex and has not been the subject of utilizable synthesis work which would permit the definintion of a steel for a given modulus of elasticity. J. T. Leukkeri - The elastic module of facecentred cubic transition metal alloys. J.Phy.GBR 1981-11-(10). P.1997–2005. Stankovic D., Pajevic M.B. - Determination of some factors influencing the modulus of elasticity of Gray Cast Iron. Livarski Vestn. 1981 - 28 - (4). P.97–102.

It is known in addition that an increase of temperature and also of stresses to a level giving rise to microplastic deformation entails a lowering of the modulus of elasticity. Vojtenko-A. F., Skripnik Yu.D., Solovena N. G., Nadezhdin G. N. - Effect of the threshold of stresses on Young's Modulus, INST. Problem Prochnosti - 1982 - No. 11 - P.83–86.

The obtaining of a good Young's modulus cannot be the main aim of a search for a high performance steel. As a matter of priority, this search must be centered on the optimization of resistance to thermal fatigue.

As a first approach, it follows from the description of the stress cycle that resistance to fatigue of thermal origin appears to be directly linked to the mechanical charcteristics of the steel at the temperatures occurring during stressing, and in particular to be directly linked to the elastic limit of the material.

The influence of chromium, molybdenum (which raises softening temperatures), vanadium (which improves high-temperature characteristics), and that of carbon (which by precipitating the carbides formed with these elements will harden the steel) are known.

It is understood how to use elements such as nickel, manganese or silicon to give steel a homogeneous and stable structure, with good tenacity.

Hot tool steels are thus known which are used in particular for forging and stamping steel, and which have good high-temperature elastic limit, good resistance to thermal fatigue and would appear to be utilizable for the production of hoops for rolls for the continuous casting of aluminium. However, the thermal conductuivity of these steels is too low, so that more or less considerable losses or even mishaps occur, or it may be impossible to operate the machine.

The search for an optimized steel composition for continuous casting hoops consists in making the best possible use of alloying elements with a view to obtaining the best possible resistance together with thermal conductivity very little different from that of standard steels.

The criteria for selection are of course the mechanical characteristics of the steel. Nevertheless, fatigue of thermal origin is a complex mechanism. In addition to the effect of stresses resulting from the cycling of the temperature gradient, it combines the effects of external attack and those of internal modifications of the material, which influence the formation and development of the network of cracks.

The selection of materials is guided not only by their traditional mechanical characteristics, but also by their behaviour under stresses due to fatigue of thermal origin, with the aid of a specific simulation test which will be described below.

Thus, in order to meet the criteria of good productivity and maximum life, which in practice are contradictory, the Applicants' studies have made it possible to determine a grade of steel, as defined above, for which a reduction of thermal conductivity, which is acceptable from the point of view of industrial operation, nevertheless leads to a surprising improvement of resistance to cracking through thermal fatigue.

The hoops for casting rolls according to the present invention are made from a grade of steel produced in an electric furnace, poured into a ladle in which it is refined and degassed, and finally cast in an ingot mould. The ingots are heated to about 1200° C., run off to obtain blanks which are in turn forged into tubes of a diameter of 500 to 1000 millimeters. These blanks are then austenitized at about 970° C., and then quenched and subjected to annealing to give them the required metallurgical quality.

It should be noted that the grades of steel according to the present invention are characterized by simplicity of operation during high-temperature conversion and subsidiary treatments for the refining of their structure to obtain the best possible ductility properties, which is difficult to achieve with grades having a higher carbon content or containing more alloying elements.

The blanks thus obtained are then machined to size.

Table I below indicates the compositions by weight of the various steels tested, for purposes of comparison.

TABLE I

| | Composition in % by weight | | | | | | | | |
|---|---|---|---|---|---|---|---|---|---|
| Grade | C | Mn | Si | P | S | Ni | Cr | Mo | V |
| 1 Prior art | 0.54 | 0.85 | 0.35 | 0.015 | 0.008 | 0.55 | 1.20 | 0.45 | 0.15 |
| 2 Prior art | 0.56 | 0.75 | 0.30 | 0.012 | 0.006 | 0.45 | 1.00 | 0.45 | 0.18 |
| 3 Invention | 0.32 | 0.50 | 0.35 | 0.012 | 0.003 | 0.15 | 3.15 | 0.95 | 0.20 |
| 4 Invention | 0.34 | 0.35 | 0.30 | 0.010 | 0.002 | 0.20 | 30 | 1.05 | 0.18 |

After undergoing the metallurgical quality treatments described above, the steels are subjected to the following tests:

Firstly, a test for the purpose of determining tension characteristics of test pieces fractured at a temperature of 630°. The results of these tests are summarized in Table II.

TABLE II

| Grade | R M Pa | R 0.002 M Pa | Z % |
|---|---|---|---|
| 1 | 360 | 220 | 92 |

TABLE II-continued

| Grade | R M Pa | R 0.002 M Pa | Z % |
|---|---|---|---|
| 2 | 375 | 230 | 88 |
| 3 | 550 | 430 | 92 |
| 4 | 560 | 435 | 90 |

Resistance to thermal fatigue tests were also carried out with a specific arrangement described below.

This comprises a finely ground cylindrical test piece which is intermittently heated on its surface by high-frequency induction and which is continuously cooled internally by water circulation.

The definition of the test piece, the power of the generator, the coupling between inductance coil and test piece, and the cooling made it possible to define a thermal cycle based on measurements of temperatures recorded on actual hoops in operation.

Certain types of thermal fatigue tests, such as the Northcott and Baron test, relate solely to the superficial appearance of the cracks. This criterion is not satisfactory, because it gives no information relating to the penetration of the cracks. The criterion adopted is therefore the count and the depth of the cracks observed on a test piece section per 10 linear millimeters of surface.

The reliability of this test is shown by the excellent correlation observed between the examinations of test pieces and the appearance and development of cracks on the actual hoops made with the same materials.

Figure 4:
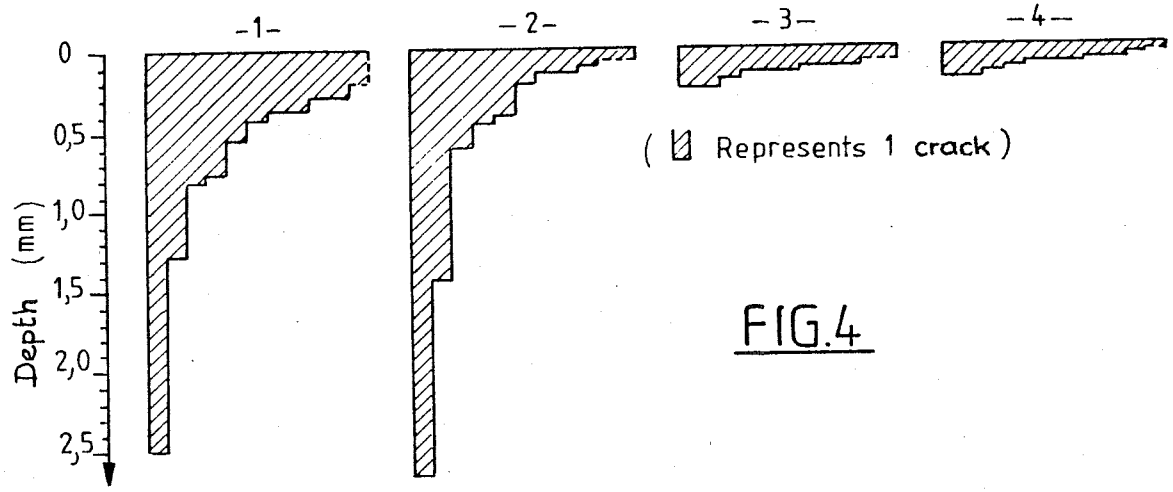
FIG. 4 shows histograms illustrating the number and depth of the cracks for four grades of steel - two according to the prior art and two according to the invention.

The results of tests are given in a histogram shown in FIG. 4, where the numbers and depths of the cracks are displayed. The mechanism of the cracking is always similar: the first cracks to appear, starting from surface micro-accidents, are those which show the greatest development in depth. A network of secondary cracks of lesser extent is then formed. The criterion adopted is the maximum depth of the principal cracks: these are the cracks which in a hoop determine the amount of metal to be removed in order to recondition the working surface.

The improvement of resistance to fatigue of thermal origin consists of an unexpected reduction of the mesh of the network of main cracks, and a reduction of the maximum depths of cracks, all other factors being the same. In the steel of the prior art the frequency of the first cracks to start is about one to two cracks per linear centimeter. These main cracks, which penetrate deeply, determine the useful life of the hoop before reconditioning.

In the steel according to the present invention the frequency of cracks starting practically simultaneously is far higher. The distribution of deformation and stresses due to thermal cycling is thereby spread out, thus contributing towards the reduced penetration of the deterioration through thermal fatigue.

This is made clear in FIG. 4 by the results obtained statistically with test pieces under the previously described test conditions of thermal cycling between 50° and 630°, representing the operation of a continuous casting hoop. For the same number of 3,000 cycles the maximum depth of the cracks, which attains 2.6 millimeters with grade 1 according to the prior art, does not exceed 0.32 millimeter with grade 3 according to the present invention.

These favourable results of resistance to thermal fatigue entail no significant alteration of the productivity of continuous casting machines equipped with hoops produced with the grade of steel according to the present invention.

Thus, a machine for the continuous casting of aluminium equipped with rolls of a diameter of 630 millimeters made it possible to cast 9960 tons in about 4,800 hours.

With a machine equipped with rolls of a diameter of 960 millimeters, 3,200 tons were cast in 1000 hours.

What is claimed is:

1. In a machine for the continuous casting of aluminium alloy comprising a feed duct for molten aluminium alloy an outlet nozzle communicating with said duct and having an outlet end, and two rotatable rolls, immediately adjacent to said outlet end for receiving the molten aluminium alloy from said outlet end and rolling the aluminium alloy to a desired thickness, each of said rolls comprising in combination a core, journals at each end of said core, an outer peripheral surface on said core defining peripheral grooves, cooling liquid inlet and outlet passageways in said core and in said journals for putting said grooves in communication with a cooling liquid supply, and a cylindrical outer sleeve having an inner surface mounted on said core and in close contact with said peripheral surface, said cooling liquid communicating with said inner surface through said grooves and said passageways for cooling said sleeve ; the improvement wherein said sleeve is in a forged, heat treated and machined state and consists in an alloy steel, having the following composition in percentages by weight : C: 0.30 to 0.36; Mn: 0.30 to 0.60; Si: 0.15 to 0.45; Ni: less than 0.40; Cr: 2.80 to 3.40; Mo: 0.85 to 1.25; V: 0.10 to 0.30: S: ≦0.020; P: ≦0.020; Cu: ≦0.30, the balance being substantially iron and residual impurities.

2. In a machine according to claim 1, wherein said steel has the following composition in percentages by weight : C: 0.31 to 0.35; Mn: 0.30 to 0.50; Si: 0.15 to 0.35; Ni: less than 0.25; Cr: 2.80 to 3.40; Mo: 0.90 to 1.10; V: 0.13 to 0.20; S: ≦0.020; P: ≦0.020; Cu: ≦0.30, the balance being substantially iron and residual impurities.

* * * * *